United States Patent [19]

Hill

[11] 4,362,195

[45] Dec. 7, 1982

[54] PORTABLE LOG DEBARKING APPARATUS

[75] Inventor: Louis F. Hill, Sweet Home, Oreg.

[73] Assignee: Pacific Rim Equipment Corp., Sweet Home, Oreg.

[21] Appl. No.: 223,701

[22] Filed: Jan. 9, 1981

[51] Int. Cl.[3] ..... B27L 1/06

[52] U.S. Cl. ..... 144/242 R; 83/160; 83/928; 144/208 E; 144/242 M; 144/242 A

[58] Field of Search ..... 83/928, 159, 160; 198/452; 144/2 Z, 208 R, 208 E, 242 R, 242 A, 242 M

[56] References Cited

U.S. PATENT DOCUMENTS

| | | | |
|---|---|---|---|
| 3,285,305 | 11/1966 | Nicholson | 144/208 R |
| 3,392,764 | 7/1968 | Yeadon | 144/208 R |
| 4,027,563 | 6/1977 | Weavell | 83/160 |

FOREIGN PATENT DOCUMENTS

| | | | |
|---|---|---|---|
| 757416 | 4/1967 | Canada | 144/208 E |
| 2823087 | 11/1979 | Fed. Rep. of Germany | 144/208 E |

*Primary Examiner*—W. D. Bray

*Attorney, Agent, or Firm*—Eugene M. Eckelman

[57] ABSTRACT

An elongated infeed frame supporting a debarking unit has a trailer-like structure so that it is readily portable and can be transported into a logging or debarking area. An off-bearing frame is also portable for easy transportation to the area. Each of the infeed and off-bearing frames has structure providing side loading and unloading, respectively, so as to be worked in a minimum area. Also, each of the two frames has outriggers for selectively supporting them on uneven ground and at desired planes and at desired angles relative to each other. Hold-down and guiding mechanism are provided for efficiently directing the logs into and out of the debarking unit.

16 Claims, 8 Drawing Figures

PORTABLE LOG DEBARKING APPARATUS

BACKGROUND OF THE INVENTION

This invention relates to new and useful improvements in log debarking apparatuses and is particularly concerned with such an apparatus which is portable for readily transporting it to the site of the logs.

Various debarking apparatuses have heretofore been provided but these former apparatuses have inherent disadvantages. One disadvantage is that they are not compact in size and futhermore are difficult to transport to desired sites, it being required either that the units be disassembled for transportation or else a number of transporting vehicles be used. Attempts have been made to provide portable debarkers but they have many disadvantages one of which is that they are complex in construction and also they require a large space for their operation. Furthermore, such debarkers have not been able to efficiently handle small diameter crooked logs.

SUMMARY OF THE INVENTION

According to the present invention and forming a primary objective thereof, a portable log debarking apparatus is provided that is compact and simplified in its structure for convenient movement from one site to the other and which takes up a minimum of area at the debarking site. Another object is to provide a portable debarking apparatus that efficiently handles small crooked logs.

For carrying out these objectives, the apparatus of the invention includes two main portable parts comprising an elongated infeed frame having wheel support at one end and a hitch at the other end whereby to be transported by a pulling vehicle. A debarking unit is mounted on one end of the infeed frame and is fed by a powered conveyor on such frame. One side of the infeed frame is unobstructed along substantially its full length so that logs can be loaded from the side. Stop means are provided on the opposite side from the loading side to limit lateral movement of the logs being loaded. The other portion of the apparatus comprises a separate elongated off-bearing frame arranged to be supported on the ground in end to end relation with the infeed frame and arranged to receive logs discharged from the debarking unit. The off-bearing frame has a conveyor for moving the logs therealong and has an unobstructed side over which the logs may be discharged by laterally operating powered kicker mechanisms, thus providing side unloading. The infeed frame has a vertically adjustable feed segment adjacent to the debarker unit to accurately feed logs into the debarker unit, and the frame is also provided with hold-down means for further guided feeding of the logs into the debarker unit. Both of the infeed and off-bearing frames have vertically and laterally adjustable outriggers for stabilized support on the ground and for suitable tilted and angled relation for most efficient movement of logs along them. In addition, the two frames are provided with guards over the outriggers to protect the outriggers on those sides at which the logs are loaded or unloaded.

The invention will be better understood and additional objects and advantages will become apparent from the follow-description taken in connection with the accompanying drawings.

DETAILED DESCRIPTION OF A PREFERRED EMBODIMENT

Figures 1, 2:
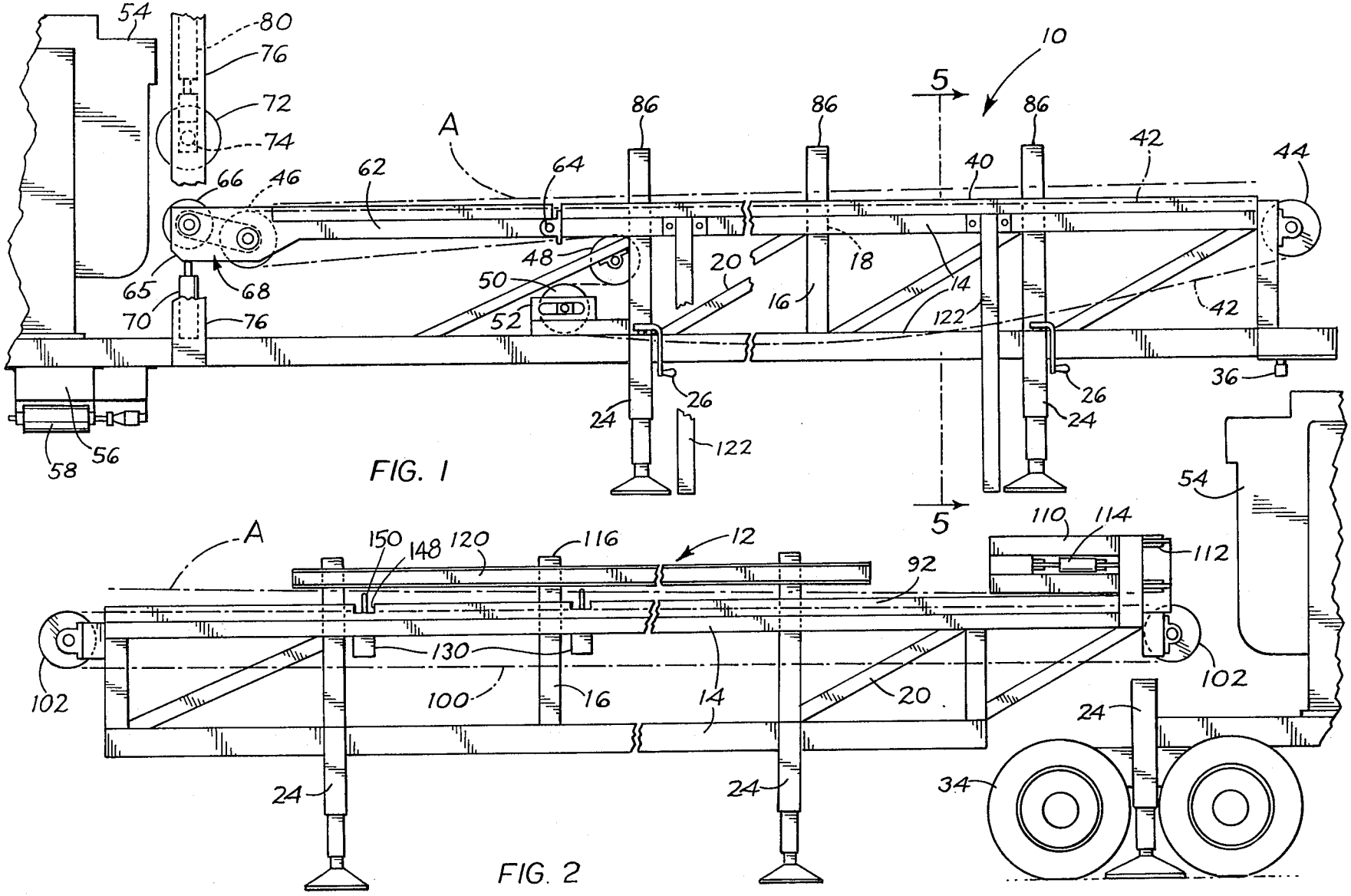
FIG. 1 is a fragmentary foreshortened side elevational view of a portion of the portable log debarking apparatus of the invention, this view showing the infeed frame portion.
FIG. 2 is a fragmentary foreshortened side elevational view of the remaining portion of the apparatus, this view showing the off-bearing portion.
Figure 3:
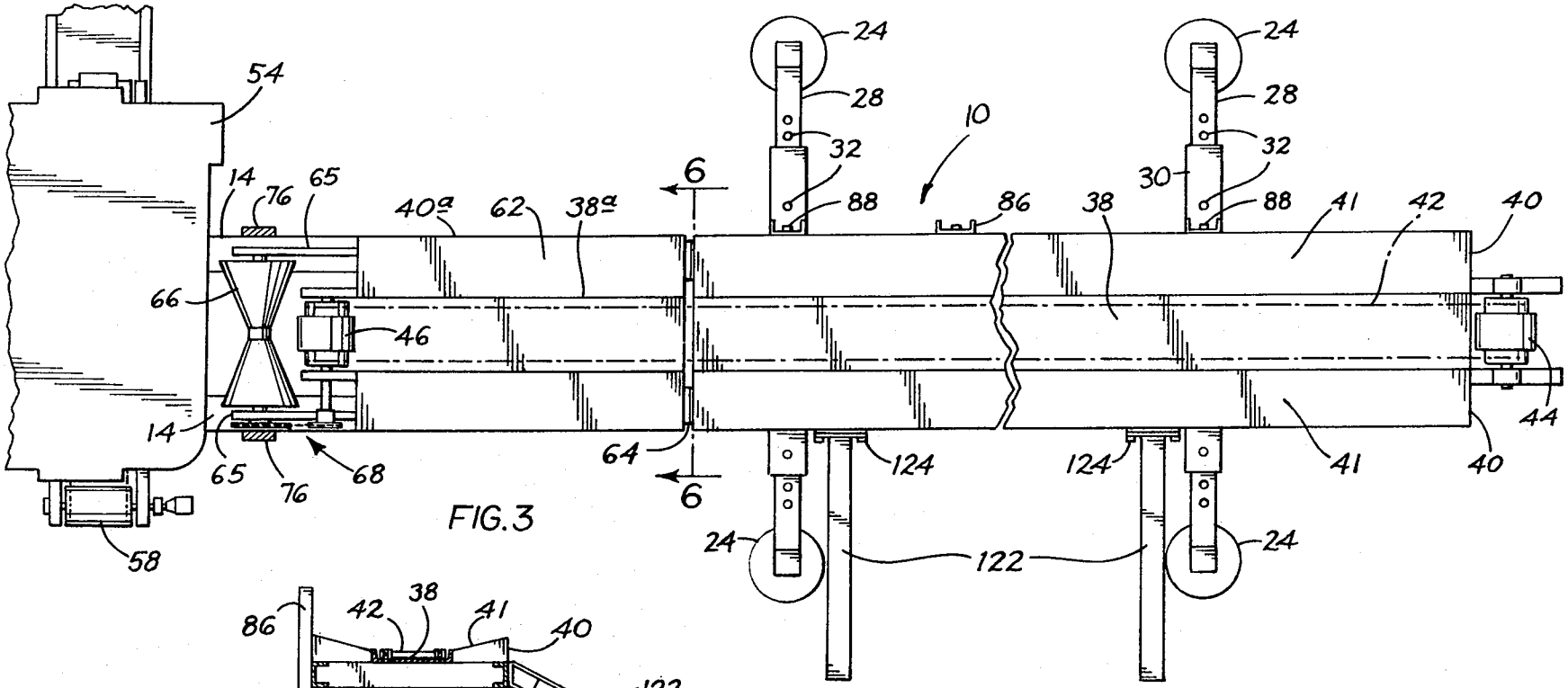
FIG. 3 is a fragmentary foreshortened top plan view of the portion of the apparatus shown in FIG. 1.
Figure 4:
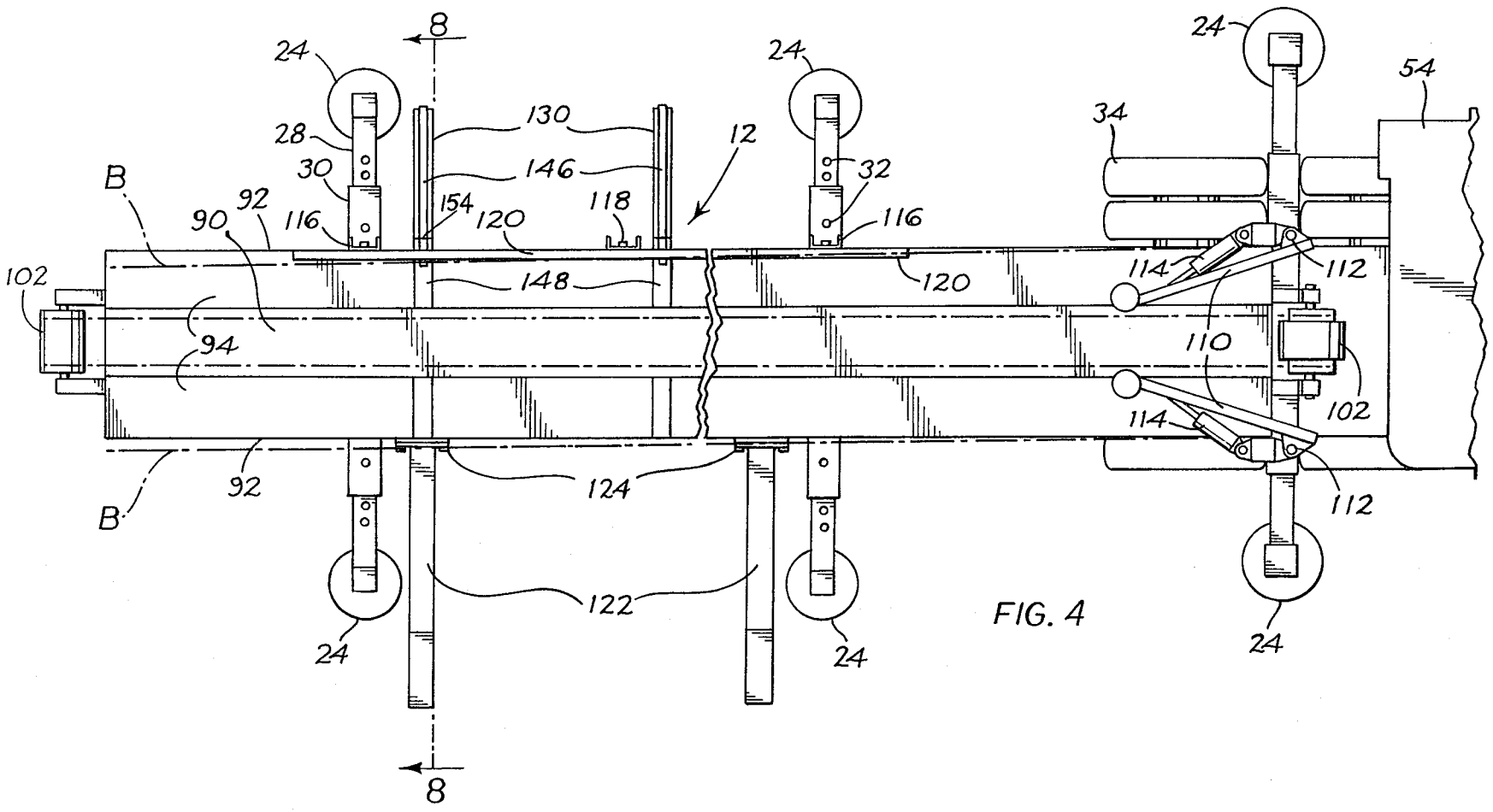
FIG. 4 is a fragmentary foreshortened top plan view of the portion of the apparatus shown in FIG. 2.

With particular reference to the drawings, the invention comprises essentially two main frames, comprising infeed frame 10, FIGS. 1 and 3, and an off-bearing frame 12, FIGS. 2 and 4. Each of these frames comprises an open box-like frame structure with suitable longitudinal frame pieces 14, vertical frame pieces 16, and transverse frame pieces 18. Reinforcing struts 20 are provided as necessary.

Each of the infeed and off-bearing frames has outriggers 24 on each side to stabilize these frames on the ground. Each outrigger has vertical adjustment in a conventional manner, such as by the use of a hand crank 26, FIG. 1, arranged to operate an internal screw shaft or rack (not shown). Outriggers 24 have inwardly extending arms 28 with telescoping connection in lateral tubular housings 30 integral with the frames 10 and 12. Arms 28 and housings 30 have releasable adjustable connections 32, FIGS. 3 and 4, such as matching apertures and pins to provide lateral adjustable positioning of the arms. By means of the vertical and lateral adjustment of the outriggers, the said outriggers can accommodate uneven ground at the log debarking site and also can support the frames 10 and 12 in desired infeed and off-bearing planes relative to the ground.

Infeed frame 10 has a tandem wheel assembly 34 at one end, FIGS. 2 and 4, and a hitch mechanism 36 at the other end, FIG. 1, thus providing a trailer-like vehicle arranged to be transported from one place to the other by means of a pulling vehicle. The outriggers 24 are retracted inwardly and raised, or entirely removed, when the apparatus is being transported. The off-bearing frame member 12, being of simplified and lightweight structure, can be loaded onto a carrying vehicle such as a trailer and pulled to the logging site.

Figure 5:
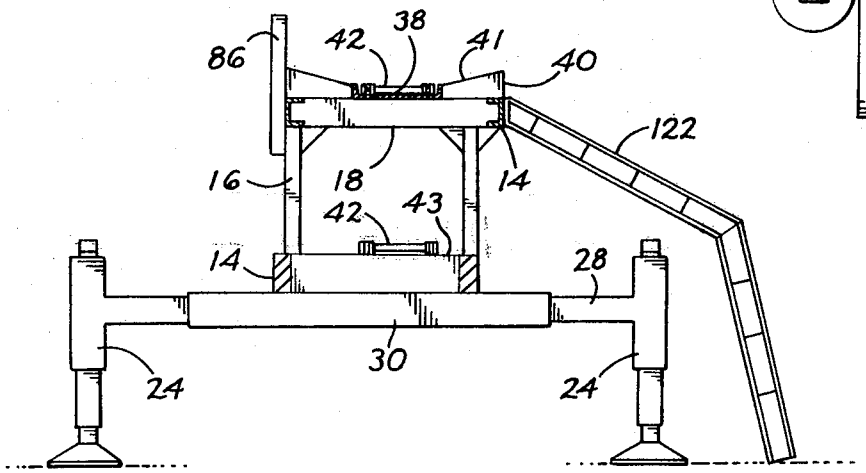
FIG. 5 is a cross sectional view of the infeed frame taken on the line 5—5 of FIG. 1.

Infeed frame 10 has a top floor portion 38, FIGS. 3 and 5, recessed between side wing portions 40 having tapered top surfaces 41 leading down toward the floor 38 to form a channel-type intermediate area. An endless conveyor 42 operates along the floor 38 and has return movement on bottom floor 43. Endless conveyor 42 may be of any suitable conventional type such as chain or belt structure and is shown in broken lines for clarity of other parts. This conveyor operates over wheel 44 at the hitch end of the frame, over a wheel 46 adjacent the other end, and over two wheels 48 and 50 in the lower return flight thereof. All of the wheels for the conveyor have suitable journaled support on the frame 10, the wheels 48 and 50 being mounted in off-set relation so as to provide an S-type flight segment. By such arrangement, one of the wheels 48 and 50, such as the wheel 50, has an adjustable support 52 arranged to vary the slack or tensioning condition of the conveyor. One of the wheels in the conveyor assembly, preferably wheel 50, is suitably power driven.

The wheel support end of the infeed frame 10 carries a debarker unit 54 of conventional structure, such debarker unit having suitable self-feeding means and operating knives capable of debarking a log upon introducing a log endwise thereto, namely, endwise from the conveyor 42. Debarker 54 has a bottom outlet 56 for removed bark, and such outlet is associated with a power driven transverse conveyor 58 which transfers the removed bark to a side disposal point.

Figure 6:
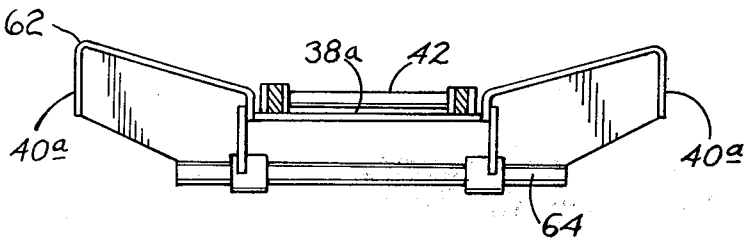
FIG. 6 is a fragmentary cross sectional view of a feed segment of the infeed frame taken on the line 6—6 of FIG. 3.

The end of the frame 10 adjacent the debarker 54 has a feed segment 62, FIGS. 1, 3 and 6, comprising a floor extension 38*a* of the top floor 38 of the infeed frame and pivotally connected thereto by a transverse pivot connection 64. This feed segment is also trough shaped having side wing portions 40*a* which form extensions of side wings 40 and a recess for the conveyor 42 for moving a log into the debarker. Journaled at the free end of the feed segment 62 on arms 65 integral with said feed segment is a double cone-type support roller 66 disposed a short distance above the conveyor and over which a log is arranged to pass for feeding movement into the debarker 54. This roller is driven by a drive sprocket assembly 68 from the sprocket wheel 46. Thus, a log being fed toward the debarker by the conveyor 42 will ride up on the roller 66 and be driven by such roller and by the conveyor into the debarker unit. The feed segment 62 is supported on the frame 10 at its free end by a fluid operated cylinder 70, and by suitable operation of such cylinder, the feed segment 62 can be elevated as desired to direct a log endwise into the debarker. Such adjustment is made as necessary to accommodate logs of different size and shape.

Figure 7:
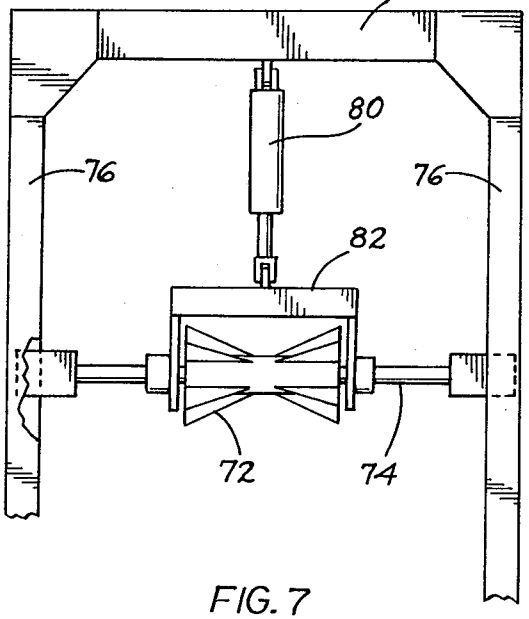
FIG. 7 is a fragmentary elevational view of hold-down means on the infeed frame for guiding logs into the debarking unit.

A double cone-type hold-down roller 72, best seen in FIGS. 1 and 7 and omitted from FIG. 3 for clarity, is provided for engagement with the top of the logs as they are fed into the debarker. This roller is disposed vertically above the roller 66 and is supported on a cross shaft 74 slidably guided in channel-shaped side posts 76 of an inverted U-shaped frame 78 secured integrally to the frame 10. Shaft 74 and roller 72 are biased downwardly by a hydraulically pressured cylinder 80 connected between the frame 78 and an inverted U-shaped connector 82 on the shaft.

As seen in FIGS. 1, 3 and 5, the infeed frame 10 has a plurality of upright arms 86 bolted to one side thereof by bolts 88. Such arms are on the side opposite from the loading side to form stops for logs being placed on the infeed frame, as will be more apparent hereinafter.

Figure 8:
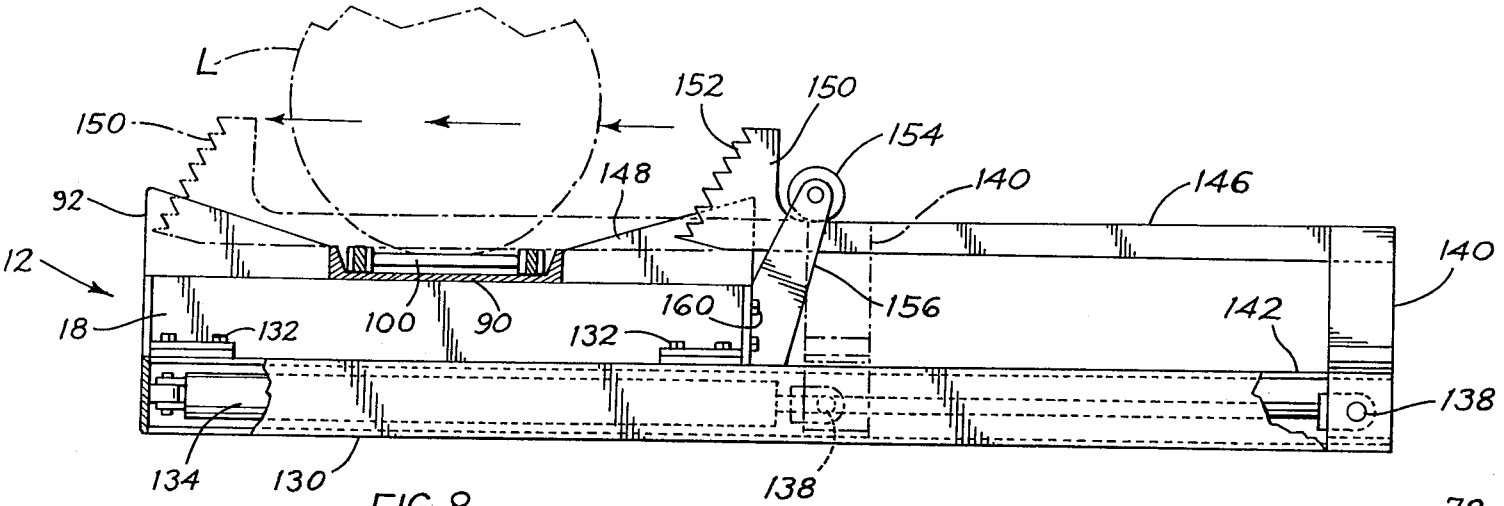
FIG. 8 is an enlarged cross sectional view taken on the line 8—8 of FIG. 4, this view showing details of a power operated kicker mechanism for unloading a barked log.

Off-bearing frame 12 has a top floor portion 90, FIGS. 4 and 8, recessed between side wing portions 92 having tapered top surfaces 94 leading down toward the floor 90. An endless conveyor 100 operates along the floor 90. Conveyor 100 operates over opposite end wheels 102 and travels away from the debarker, one of the wheels, such as the rearward one, being power driven. Similar to the conveyor 42, conveyor 100 may comprise any type of conventional conveyor and is shown in broken lines for clarity.

The forward end of the off-bearing frame, namely, the end adjacent the debarker, has a log centering mechanism arranged to receive a lead end of a log from the debarker and direct the log substantially centrally along the off-bearing frame. Such centering mechanism comprises a pair of arms 110, FIGS. 2 and 4, secured to the off-bearing frame by vertical axis pivot connections 112. The pivot supports of the two arms are spaced widely apart for receiving the lead end of a log from the debarker, and such arms are biased in a converging position by spring operated hydraulic closers 114 pivotally secured between the arms 110 and the off-bearing frame. Arms 110 are arranged to guide the logs from the debarker onto the conveyor 100 in substantially a straight line down the off-bearing frame.

Off-bearing frame 12 has upright arms 116 bolted thereto by bolt connections 118, and these arms support a longitudinal guide rail 120 disposed a short distance, such as one or two feet, above the frame 12. This rail comprises a channel member having its open side facing the conveyor and serves to maintain logs on the frame 12 because the edges of the rail obtain a bite on the moving logs and assist in holding them on the conveyor.

The present portable log debarker apparatus was designed for taking up minimum space so that a large debarking site is not required. For this purpose, the infeed frame 10 has no obstructions above the top floor along one side thereof whereby logs can be loaded by a suitable loader from the side rather than from the end. Such unobstructed side as seen in FIG. 3 comprises that side opposite from the upright arms 86. Thus, the logs are side loaded onto the conveyor and stop or limited movement of the logs on the other side is provided by the upright arms 86. The bolt connections 88 for the support arms 86 allow them to be mounted on either side. Thus, either side can be set up to comprise the unobstructed loading side according to conditions at the logging or debarking site. Similarly, logs are unloaded from one side of the off-bearing frame 12, namely, from the side opposite the guide rail 120, as will be more apparent hereinafter.

Guard legs 122 are arranged to be secured to infeed frame 10 on the loading side and have a dimension extending above and outward of the outriggers 24 to protect the latter from the logs being loaded. The guards 122 are mounted only on the loading side, and similar to the stop arms 86, they have a removable bolt connection 124 with the frame 10 and can be attached on either side depending upon the side that is to be used as the loading side. Similar to the infeed frame 10, the frame 12 has guard frames 122 for protecting the outriggers 24, such frames also having bolt connections 124 to provide attachment to either side of the frame.

With reference to FIGS. 2, 4 and 8, the logs are removed from the off-bearing frame 12 by fluid operated cylinder kicker mechanisms. Such mechanisms comprise a plurality of transversely extending box-like housings 130 having a removable bolt connection 132 up against the bottom of cross frame members 18 of the frame 12. These housings extend laterally beyond the width of the frame 12 and enclose a fluid-operated cylinder 134 secured to the housing 130 at the end of the housing which is directed toward the side that is to be the unloading side of the frame. The other end of the hydraulic cylinder is pivotally connected to a cross bolt 138 secured to an upright arm 140. Arm 140 extends upwardly through a top slot 142 in the housing 130 for slidable movement.

Secured to the operating arms 140 above the housings 130 but in parallel relation thereto are kicker arms 146 movable across the frame 12 in transverse grooves 148 in such frame. Kicker arms 146 have a front engaging head 150 with a toothed edge 152 which is angled so as to project outwardly a greater distance at the bottom. Such toothed edges upon engaging a log L, FIG. 8, provides a lifting engagement but at the same time bites into the log to prevent the log from rolling back over the top of the heads 150.

A hold down roller 154 is associated with each of the kicker arms 146. Such rollers are rotatably supported between upright arms 156 having a removable bolted connection 160 to the frame 12. Kicker arms 146 operate under the rollers 154 and the latter take the upward thrust that the arms may impart to themselves as they drive a log off the side of the frame. The full ejecting position of the kicker arms 146 is shown in broken lines in FIG. 8. The bolted connections for the housing 130 as well as for the hold-down roller arms 156 are detachable so that the kicker mechanisms can operate from either side of the off-bearing frame. Thus, with proper mounting on the kicker mechanisms and the outrigger guards 122, unloading can be accomplished from the desired side.

According to the invention, a portable log debarker apparatus is provided that is compact in structure and can operate in the woods in a minimum space. Frame 10 being supported on wheels, is readily transported to the desired site. Frame 12, being of light weight and compact in structure, is readily loaded on a suitable trailer for transportation to the site. By a suitable mounting arrangement of the stop arms 86, guide rail 120, outrigger guards 122, and kicker arm assemblies 130, namely, all of such elements being removably connected so as to be attachable to one side or the other, loading and unloading can be accomplished from either side to thus require a minimum space at the debarking site.

The portability of the present apparatus and the two piece construction thereof accomplishes still other advantages. One such additional advantage is that the outrigger assemblies can be adjusted vertically to position the infeed and off-bearing frames at desired levels. More particularly, it has been found that logs, especially crooked logs, will feed along the infeed frame 10 more efficiently if the latter is angled down toward the debarker, and furthermore that the debarked logs will feed more efficiently along the off-bearing frame 12 if the latter is angled up away from the debarking unit. An inclination of approximately 5 to 10 degrees accomplishes this efficient log movement. The desired angular relationship of the frames 10 and 12 is illustrated on the drawings by dash lines A in FIGS. 1 and 2.

In addition to providing an angular disposition of the frames 10 and 12 relative to the horizontal, the two piece construction allows frame 12 to be angled laterally relative to the frame 10. Thus, rather than these two frames being in direct longitudinal alignment, they can be disposed at an obtuse angle, the rearward end of frame 12 being offset in the direction of the unloading side of frame 12, namely, toward the side opposite from the kicker mechanisms. Such angular disposition of the frame 12 from straight line relation with frame 10 is approximately 5 to 10 degrees, such angular relation being illustrated by dash lines B in FIG. 4. The inclined relationship of the two frames, as well as the angular relationship in the longitudinal direction and the function of the guide rail 120 provide efficient movement of logs, and especially crooked logs, into and through the debarker and along the off-bearing frame.

The conveyor mechanisms and debarker are operated suitably by fluid or electric power, and for this purpose, a vehicle having suitable generating equipment thereon, such as an electrical generator, a compressor mechanism, and other structure as necessary, can be used to accompany the debarking unit. Such vehicle may also include controls for operating the debarking unit from a distance.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A portable log debarking apparatus comprising (a) an elongated infeed frame having road engaging wheel support means at one end thereof, (b) a hitch on the other end of said frame arranged to be connected to a pulling vehicle for movement of the frame to a site of logs to be debarked, (c) a power driven debarking unit on said frame adjacent one end, (d) a power driven conveyor on said infeed frame operating toward said debarking unit, (e) said conveyor being arranged to feed logs deposited thereon longitudinally into said debarking unit, (f) one side of said infeed frame being unobstructed along a greater portion of said conveyor to allow side loading of logs onto said conveyor, (g) stop means on the other side of said frame from said unobstructed side for limiting the loading travel of logs when side loaded onto said conveyor, (h) and an off-bearing frame arranged to receive logs discharged from said debarking unit, (i) said off-bearing frame having free standing support on the ground whereby also to be portable.

2. The portable log debarking apparatus of claim 1 wherein said off-bearing frame has a conveyor for moving debarked logs longitudinally along said off-bearing frame from said debarking unit, one side of said off-bearing frame being unobstructed to provide side unloading of logs therefrom, and power driven unloading means arranged to discharge logs from said conveyor over said unobstructed side.

3. The portable log debarking apparatus of claim 1 wherein said off-bearing frame has a conveyor for moving debarked logs longitudinally along said off-bearing frame from said debarking unit, one side of said off-bearing frame being unobstructed to provide side unloading of logs thereon, power driven unloading means arranged to discharge logs from said conveyor over said unobstructed side, vertically adjustable outriggers on each side of said infeed and off-bearing frames providing side stabilizing support, and guard means extending outwardly and above said outriggers on the loading side of said infeed frame and on the unloading side of said off-bearing frame to protect said outriggers from logs being loaded and unloaded.

4. The portable log debarking apparatus of claim 1 wherein said off-bearing frame has a conveyor for moving debarked logs longitudinally along said off-bearing frame from said debarking unit, one side of said off-bearing frame being unobstructed to provide side unloading of logs therefrom, power driven unloading means arranged to discharge logs from said conveyor over said unobstructed side, vertically and laterally adjustable outriggers on each side of said infeed and off-bearing frames providing side stabilizing support, and guard means extending outwardly and above said outriggers on the loading side of said infeed frame and the unloading side of said off-bearing frame to protect said outriggers from logs being loaded and unloaded.

5. The portable log debarking apparatus of claim 1 wherein said infeed frame includes a feed segment at the end adjacent said debarking unit, said feed segment being movable vertically for guiding logs into said debarking unit, and log engaging hold-down means above said feed segment arranged in cooperation with said feed segment to guide a log into said debarking unit.

6. A portable log debarking apparatus comprising (a) an elongated infeed frame, (b) an elongated off-bearing frame, (c) said two frames being independent from the other and being arranged to be transported to a debarking site, (d) support means supporting said two frames in end to end relation;

(e) a power driven debarking unit on said infeed frame adjacent the end by said off-bearing frame, (f) conveyor means on each of said frames arranged to convey logs into said debarking unit and to carry them away from said debarking unit, (g) one side of each of said infeed and off-bearing frames being unobstructed to provide a loading on said infeed frame and an unloading side on said off-bearing frame, (h) said support means including vertically adjustable legs arranged to angle said infeed down toward said debarking unit.

7. The portable log debarking apparatus of claim 6 wherein said support means includes vertically adjustable legs on said off-bearing frame arranged to angle said off-bearing frame up away from said debarking unit.

8. The portable log debarking apparatus of claim 6 wherein the longitudinal direction of said off-bearing frame is angled relative to the longitudinal direction of said infeed frame.

9. The portable log debarking apparatus of claim 6 including a longitudinal channel-shaped guide rail on said off-bearing frame mounted on the side opposite from said unloading side, said guide rail having the open side of its channel shape facing said unloading side whereby to obtain a sliding bite on a log that may come into engagement therewith so as to direct the log along said off-bearing frame, the longitudinal direction of said off-bearing frame being angled relative to the longitudinal direction of said infeed frame.

10. A portable log debarking apparatus comprising (a) an elongated infeed frame having road engaging wheel support means at one end thereof, (b) a hitch on the other end of said frame arranged to be connected to a pulling vehicle for movement of the frame to a site of logs to be debarked, (c) a power driven debarking unit on said frame adjacent one end, (d) a powered driven conveyor on said infeed frame operating toward said debarking unit, (e) said conveyor being arranged to feed logs deposited thereon longitudinally into said debarking unit, (f) a longitudinal feed segment at the end of said infeed frame adjacent said debarking unit, (g) said feed segment having opposite ends and having lateral pivotal connection to said infeed frame at its end which is away from said debarking unit, (h) means arranged to raise and lower said feed segment around its pivot end for guiding logs into said debarking unit, (i) one side of said infeed frame being unobstructed along a greater portion of said conveyor to allow side loading of logs onto said conveyor, (j) and stop means on the other side of said frame from said unobstructed side for limiting the loading travel of logs when side loaded onto said conveyor.

11. The portable log debarking apparatus of claim 10 including a lateral roller on the end of said infeed segment adjacent said debarking unit, and log engaging hold-down means on said frame above said feed segment arranged in cooperation with said lateral roller to guide a log into said debarking unit.

12. The portable log debarking apparatus of claim 10 wherein said conveyor on said infeed frame continues along said feed segment.

13. A portable log debarking apparatus comprising (a) an elongated infeed frame having road engaging wheel support means at one end thereof, (b) a hitch on the other end of said frame arranged to be connected to a pulling vehicle for movement of the frame to a site of logs to be debarked, (c) a power driven debarking unit on said frame adjacent one end, (d) a power driven conveyor on said infeed frame operating toward side debarking unit, (e) said conveyor being arranged to feed logs deposited thereon longitudinally into said debarking unit, (f) one side of said infeed frame being unobstructed along a greater portion of said conveyor to allow side loading of logs onto said conveyor, (g) stop means on the other side of said frame from said unobstructed side for limiting the loading travel of logs when side loaded onto said conveyor, (h) and vertically adjustable leg means on said infeed frame arranged to angle the latter down toward said debarking unit.

14. A portable log debarking apparatus comprising (a) an elongated infeed frame having road engaging wheel support means at one end thereof, (b) a hitch on the other end of said frame arranged to be connected to a pulling vehicle for movement of the frame to a site of logs to be debarked, (c) a power driven debarking unit on said frame adjacent one end, (d) a power driven conveyor on said infeed frame operating toward said debarking unit, (e) said conveyor being arranged to feed logs deposited thereon longitudinally into said debarking unit, (f) one side of said infeed frame being unobstructed along a greater portion of said conveyor to allow side loading of logs onto said conveyor, (g) stop means on the other side of said frame from said unobstructed side for limiting the loading travel of logs when side loaded onto said conveyor, (h) an off-bearing frame arranged to receive logs discharged from said debarking unit, (i) said off-bearing frame having free standing support on the ground whereby also to be portable, (j) and vertically adjustable leg means on said infeed frame and on said off-bearing frame arranged to angle said infeed frame down toward said debarking unit and to angle said off-bearing frame up away from said debarking unit.

15. A portable log debarking apparatus comprising (a) an elongated infeed frame having road engaging wheel support means at one end thereof, (b) a hitch on the other end of said frame arranged to be connected to a pulling vehicle for movement of the frame to a site of logs to be debarked, (c) a power driven debarking unit on said frame adjacent one end, (d) a power driven conveyor on said infeed frame operating toward said debarking unit, (e) said conveyor being arranged to feed logs deposited thereon longitudinally into said debarking unit, (f) one side of said infeed frame being unobstructed along a greater portion of said conveyor to allow side loading of logs onto said conveyor, (g) stop means on the other side of said frame from said unobstructed side for limiting the loading travel of logs when side loaded onto said conveyor, (h) and an off-bearing frame arranged to receive logs discharged from said debarking unit, p1 (i) said off-bearing frame having free standing support on the ground whereby also to be portable, (j) the longitudinal direction of said off-bearing frame being angled relative to the longitudinal direction of said infeed frame.

16. A portable log debarking apparatus comprising (a) an elongated infeed frame having road engaging wheel support means at one end thereof, (b) a hitch on the other end of said frame arranged to be connected to a pulling vehicle for movement of the frame to a site of logs to be debarked, (c) a power driven debarking unit on said frame adjacent one end, (d) a power driven conveyor on said infeed frame operating toward said debarking unit, (e) said conveyor being arranged to feed logs deposited thereon longitudinally into said debarking unit, (f) one side of said infeed frame being unobstructed along a greater portion of said conveyor to allow side loading of logs onto said conveyor, (g) stop means on the other side of said frame from said unobstructed side for limiting the loading travel of logs when side loaded onto said conveyor, (h) an off-bearing frame arranged to receive logs discharged from said debarking unit, (i) said off-bearing frame having free standing support on the ground whereby also to be portable, (j) said off-bearing frame having an unobstructed unloading side to allow side unloading of logs from said off-bearing frame, (k) and a longitudinal channel-shaped guide rail on said off-bearing frame mounted on the side opposite from said unloading side, (l) said guide rail having the open side of its channel shape facing said unloading side whereby to obtain a sliding bite on a log that may come into engagement therewith so as to direct the log along said off-bearing frame, (m) the longitudinal direction of said off-bearing frame being angled relative to the longitudinal direction of said infeed frame.

* * * * *